United States Patent [19]

Iwase

[11] Patent Number: 4,557,206

[45] Date of Patent: Dec. 10, 1985

[54] SEWING MACHINE FOR QUILTS AND THE LIKE

[75] Inventor: Hideo Iwase, Tokyo, Japan

[73] Assignee: Prince Mishin Kabushiki Kaisha, Tokyo, Japan

[21] Appl. No.: 551,988

[22] PCT Filed: Feb. 23, 1983

[86] PCT No.: PCT/JP83/00054

§ 371 Date: Sep. 30, 1983

§ 102(e) Date: Sep. 30, 1983

[87] PCT Pub. No.: WO83/02966

PCT Pub. Date: Sep. 1, 1983

[30] Foreign Application Priority Data

Feb. 23, 1982 [JP] Japan ..... 57-27849

[51] Int. Cl.[4] ..... D05B 3/00

[52] U.S. Cl. ..... 112/121.14; 112/121; 112/102; 112/220

[58] Field of Search ..... 112/118, 119, 121.14, 112/121.11, 121.12, 121.13, 220, 102

[56] References Cited

U.S. PATENT DOCUMENTS

| | | | |
|---|---|---|---|
| 3,515,080 | 6/1970 | Ramsey | 112/121.14 |
| 4,152,994 | 5/1979 | Sugiyama | 112/121.12 |
| 4,192,241 | 3/1980 | Reed et al. | 112/121.14 |
| 4,444,134 | 4/1984 | Maruyama et al. | 112/121.12 |

FOREIGN PATENT DOCUMENTS

| | | |
|---|---|---|
| 48-19353 | 6/1973 | Japan . |
| 56-8638 | 2/1981 | Japan . |

*Primary Examiner*—Ronald Feldbaum

*Attorney, Agent, or Firm*—Cushman, Darby & Cushman

[57] ABSTRACT

A sewing machine in which a frame which is moved by to-and-fro feed device is provided to be movable forwards and backwards along a guide mechanism provided to a base; an arm unit and a base unit of sewing machine body are provided to the frame in such a manner that the arm unit and the base unit are respectively supported and guided by a pair of horizontal upper and lower guide members, which are provided to the frame and disposed vertically, to be laterally movable, the arm unit having a head and the base unit having a rotating hook complete and being separated from the arm unit; the arm unit and the base unit are moved by a lateral feed mechanism laterally and synchronously with each other along the guide members; and a supporting bed for supporting an article to be sewed is disposed between the arm unit and the base unit of the sewing machine body so that the supporting bed passes between the guide members. The sewing machine is provided with a mechanism, provided to the arm unit and including a head driving motor, for driving the head, and with a mechanism, provided to the base unit and having a rotating hook complete drive motor, for driving the rotating hook complete.

4 Claims, 6 Drawing Figures

SEWING MACHINE FOR QUILTS AND THE LIKE

FIELD OF THE INVENTION

This invention relates to sewing machines, particularly industrial sewing machine for use in sewing thick bed quilts, or forming embroideries and the like.

BACKGROUND OF THE INVENTION

In the conventional sewing machines for sewing quilts, there has been known a machine of a structure such that a bed for supporting a quilt is provided to a frame to be movable laterally, and forwards and backwards whereby the supporting bed is moved relative to the sewing machine body which is under operation to thereby sew the quilt. This sewing machine is of a system in which a quilt is moved relative to the sewing machine body, and hence has a disadvantage in that it needs a very wide floor space more than two times in each of length and width as large as the quilt. In order to overcome such disadvantage the applicant of this invention developed a sewing machine constructed so as to move the sewing machine relative to the quilt secured in position. (Japanese Patent Publication for Opposition Purpose No. 56-8638)

The above-described improved sewing machine has advantages in that it need less floor space, in that it consumes less energy, and in that the sewing operation is performed more speedily and precisely since adverse effects due to inertia are reduced. In this sewing machine, the sewing machine body is mounted to a frame, which is movable forwards and backwards, so as to be laterally movable, and a driving force is transmitted from a motor mounted on the frame to the sewing machine body through a timing belt and the like laterally extended, and hence it has a disadvantage in that it cannot perform a desired zigzag sewing since the driving of the sewing machine body is affected by the lateral movement of that sewing machine body.

Accordingly, it is an object to provide a sewing machine for quilts and the like which is capable of precisely performing zigzag sewing.

DISCLOSURE OF THE INVENTION

According to the present invention, there is provided a sewing machine in which a frame which is moved by to-and-fro feed means is provided to be movable forwards and backwards along guide means provided to a base; an arm unit and a base unit of a sewing machine body are provided to the frame in such a manner that the arm unit and the base unit are respectively supported and guided by a pair of horizontal upper and lower guide members, which are provided to the frame and disposed vertically, to be laterally movable, the arm unit having a head and the base unit having a rotating hook complete and being separated from the arm unit; the arm unit and the base unit are moved by lateral feed means laterally and synchronously with each other along the guide members; and a supporting bed for supporting an article to be sewed is disposed between the arm unit and the base unit of the sewing machine body so that the supporting bed passes between the guide members, wherein the sewing machine comprises means, provided to the arm unit, for driving the head, the driving means including a head driving motor, and means, provided to the base unit and having a rotating hook complete drive motor, for driving the rotating hook complete.

According to the present invention, the arm unit may include: an arm carriage supported on the upper guide member to be laterally movable; a head suspended from the arm carriage to be rotatable about a vertical axis; and means, provided to the arm carriage and including a motor for rotating the head. The base unit may include: a base carriage supported on the lower guide member so as to be laterally movable; a rotating hook complete supporting unit having the rotating hook complete and being mounted to an upper portion of the base carriage so as to be rotatable about a vertical axis; and means, provided to the base carriage and having a motor for rotating the rotating hook complete support unit. The head drive motor and the rotating hook complete drive motor may be provided to the arm carriage and the base carriage respectively. With such construction, the head and the rotation hook complete can be directed toward the advancing direction of the sewing machine body by turning the head and the rotating hook complete, and hence not only zigzag sewing but also embroidering can be speedily performed.

Further, according to the present invention, said head driving means may include a cylindrical member for transmitting the head driving force from the inside of the arm carriage to the inside of the head, the transmitting member being supported to be coaxially with a rotation axis of the head and to be rotatable around the rotation axis; said rotating hook driving means may include a rotating hook complete driving force transmitting member, of a cylindrical shape, for transmitting a driving force from the inside of the base carriage to the inside of the rotating hook complete supporting unit, the rotating hook complete driving force transmitting member being supported to be coaxially rotatable about the rotation axis of the rotating hook supporting unit.

The present invention may further include head braking means for applying a braking force to the head driving means to prevent the needle from displacement, and rotating hook complete braking means for applying a braking force to the rotating hook complete driving means to prevent the rotating hook complete from being actuated whereby when the head and the rotating hook complete supporting unit are rotated, the braking forces are applied to the head driving means and the rotating hook complete driving means.

With this construction, the needle and the rotating hook complete are prevented from being actuated by the relative rotation of these driving mechanisms when the head and the rotating hook complete supporting unit are rotated, and therefore accurate sewing can be made.

Preferably, the head braking means and the rotating hook complete braking means include solenoid brakes and are adapted to apply braking forces to a needle drive shaft and a rotating hook complete drive shaft.

PREFERRED EMBODIMENTS OF THE INVENTION

Figure 2:
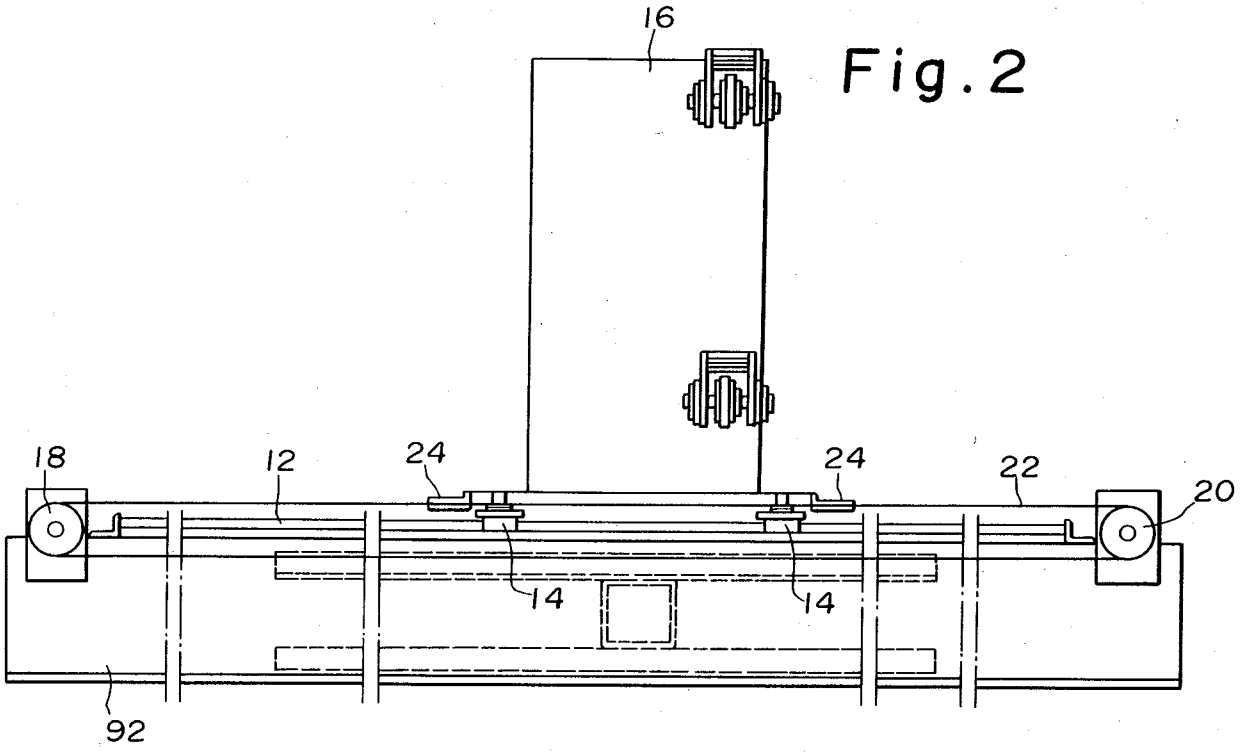
FIG. 2 is a side view of the sewing machine in FIG. 1.
Figure 3:
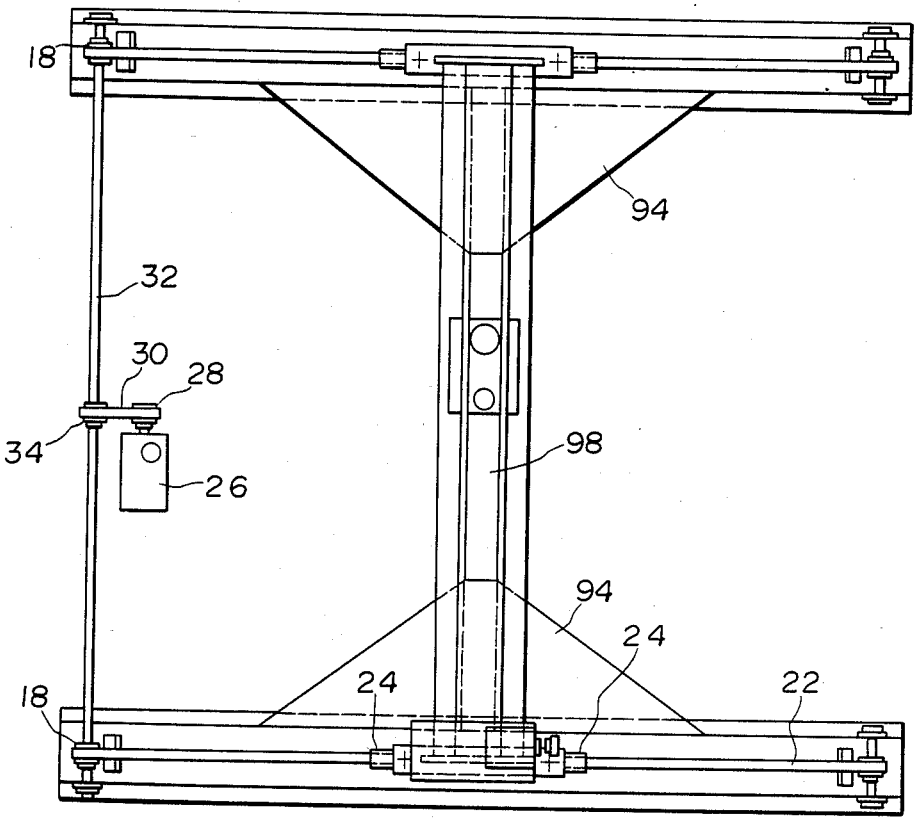
FIG. 3 is a plan view of the sewing machine in FIG. 1.
Figure 4:
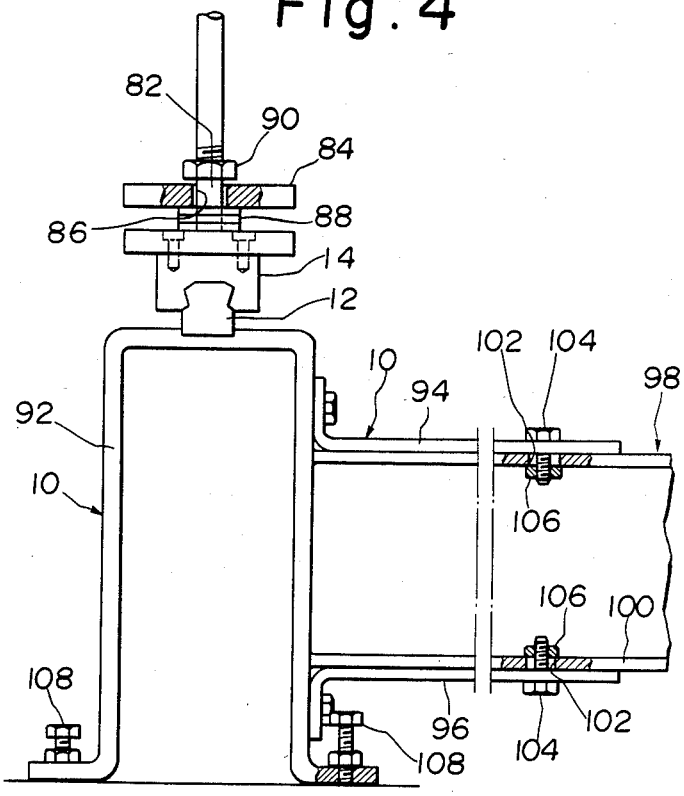
FIG. 4 is an enlarged front view illustraing an assembled structure of the base and a mounted structure of the slide shoe with respect to the frame in FIG. 1.

In the accompanying drawings, which show one embodiment of the present invention, 10 designates a base, on the upper surfaces of which guide rails 12 are provided in parallel. Above the base 10 there is provided a gate-shaped frame 16 to be movable in to-and-fro direction in FIG. 1 (in the lateral direction in FIGS. 2 and 3), the frame 16 having a plurality of slide shoes 14 slidably engaged with guide rails 12. The slide shoes 14 are attached by attachments 24 to a timing belt 22 which is wound around pulleys 18, 20 provided to the opposite ends of guide rails 12. On the forward side of base 10, there is provided a to-and-fro pulse motor 26, rotational force of which is transmitted from a timing (belt) pulley 28, which is mounted on an output shaft of that motor, through a timing belt 30 to a timing pulley 34 mounted on a rotation shaft 32 of timing pulleys 18, 18, with the result that frame 16 is driven and moved forwards and backwards along guide rails 12, 12 by the pulling of timing belts 22.

To the upper and lower portions of pole members 36, 36 of the above-described frame 16, there are respectively provided an upper beam member 38 and a lower beam member 40 so as to be horizontal and parallel in a vertical plane. To the opposed faces of these beam members 38, 40 there are fixedly attached two pairs of guide members 42,42, 44, 44 including rails of a dovetail cross-section (only two of which are shown) in parallel with each other and at predetermined intervals. These guide members 42, 44 are respectively provided with an arm unit 48 having a needle 46 and with a base unit 50 which has a rotating hook complete and is separated from arm unit 48, the units 48, 50 being arranged to be laterally movable along guide members 42, 44. More specifically, arm unit 48 and base unit 50 are each provided with two pairs of sliders 52, which are slidably engaged with guide members 42, 44 by a dovetail joint. The arm unit 48 and base unit 50 constitute sewing machine body 47 of zigzag sewing machine, broidery sewing machine, or the like. Those arm unit 48 and base unit 50 are respectively provided with a pair of actuating pulse motors 54, 56 for actuating arm unit 48 and base unit 50 in synchronism with each other and with a pair of rotating pulse motors 58, 60 for rotating arm unit 48 and base unit 50 in synchronism with each other.

Arm unit 48 and base unit 50 are connected respectively through lateral feed mechanisms 64, 66 to a driving device 62 mounted on frame 16. Feed mechanisms 64, 66 in FIG. 1 use timing belts 72 which are wound around timing pulleys 68, 70 monted on pole members 36, 36, and opposite ends of which are attached to arm unit 48 and base unit 50, so that arm unit 48 and base unit 50 can be laterally moved in synchronism with each other. Driving device 62 is connected through a timing pulley 72, timing belt 74, timing pulley 76 (coaxial with pulley 68 disposed on the front) to arm unit feed mechanism 64. This feed mechanism 64 is also connected through timing pulley 78 (coaxial with pulley 68), timing belt 80, timing pulley 82 (coaxial with pulley 68) to base unit feed mechanism 66. It is to be noted that instead of timing belt 22, which moves frame 16 along guide rails 12, and instead of timing belts 72, which move arm unit 48 and base unit 50 along guide members 42, 44, chains, or screw shaft or ball screw which moves the arm unit and base unit in cooperation with a nut may be used.

Figure 1:
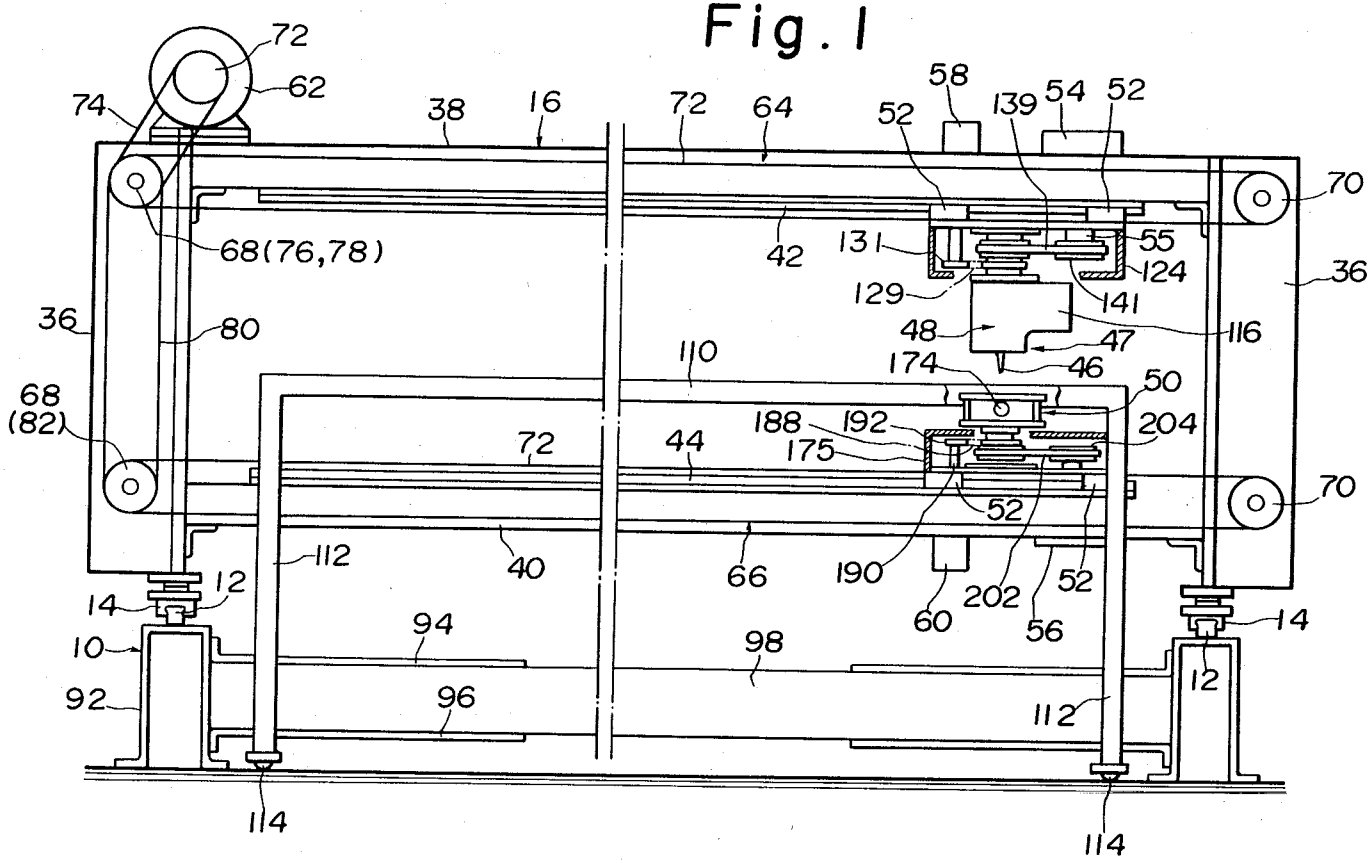
FIG. 1 is a front view of a sewing machine for sewing quilts according to this invention.

Slide shoe 14 is attached to frame 16 through a thrust bearing 88 with a shaft 82 which is projected from the upper face of the shoe 14 being inserted into a small hole 86 formed through a bottom plate 84 of frame 16, and the slide shoe is secured there by a nut 90 threaded with shaft 82. Slide shoe 14 is movable in a horizontal plane by a distance of the clearance defined between small hole 86 and shaft 82, so that design errors or thermal deformations due to changes in temperature caused by season change or operation of the apparatus. In base 10 two longitudinal members 92, 92 which are provided on their upper faces with guide rails 12 are integrally connected to a lateral member 98 through reinforcement plates 94, 96. Upper and lower flanges 100, 100 of lateral member 98 are each provided with slots 102. Lateral member 98 and reinforcement plates 94, 96 are connected by means of nuts 106, 106 and bolts 104, 104 which pass through reinforcement plates 94, 96 and the slots 102, and hence the parallel adjustment of guide rails 12, 12 can be made. Further guide rails 12 can be horizontally placed by the adjustment of horizontal adjustment bolts 108 which are provided to longitudinal members 92. In FIG. 1 a reference numeral 110 designates a supporting bed disposed at the center portion of frame 16, the bed cramping the peripheral portions of quilt or the like by means of grippers (not shown) to thereby support it between arm unit 48 and base unit 50 of sewing machine body 47. This supporting bed 110 is normally fixed to the floor, but it may be provided with a movable structure by mounting casters 114 on the lower ends of four legs 112 as shown in the figure.

Figure 5:
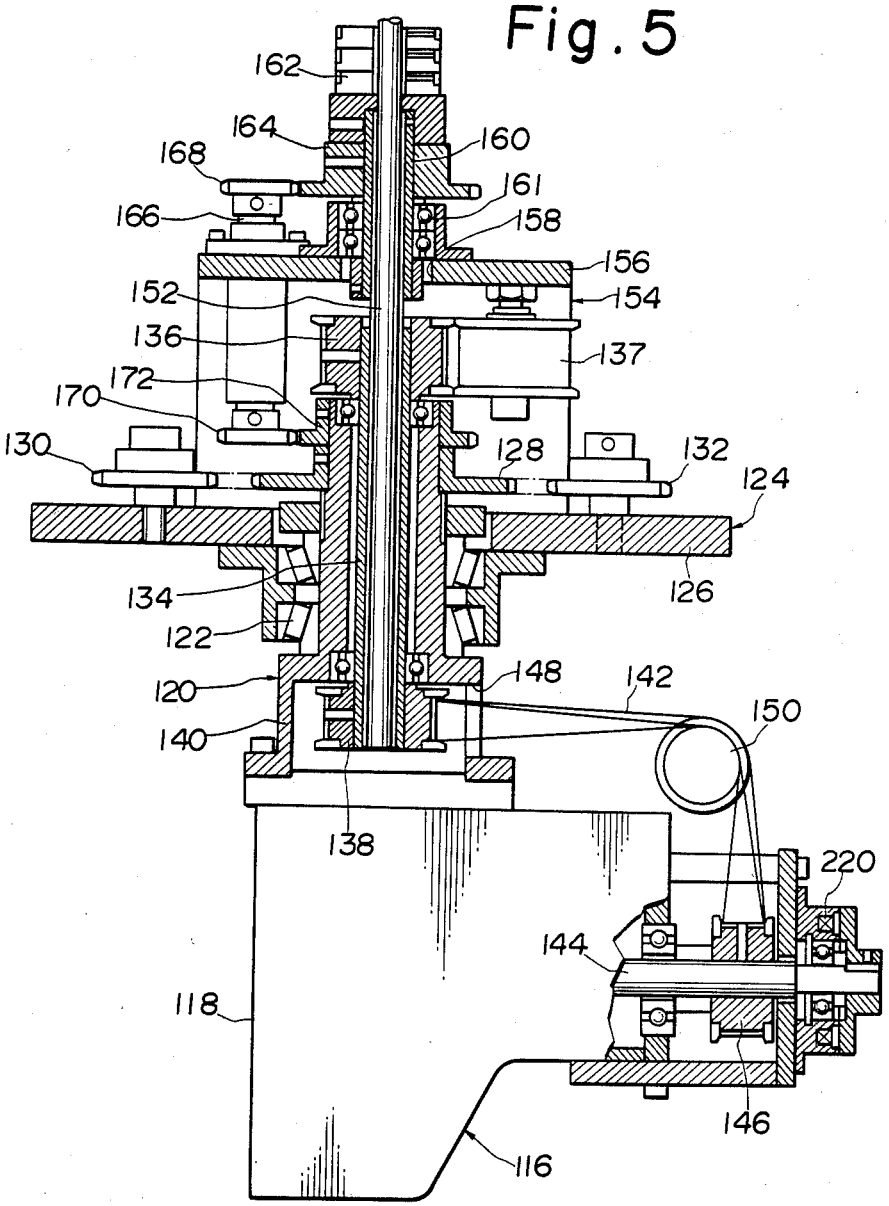
FIG. 5 is an enlarged vertical section illustrating actuating and rotating mechanisms of the head in FIG. 1.

FIG. 5 illustrates a rotating mechanism and a driving mechanism of head 116 of arm unit 48. First of all, the rotating mechanism will be explained. An outer sleeve 120 is secured at its lower end to a casing 118 of a head 116. This outer sleeve 120 is attached to a casing 126 of a carriage 124 of arm unit 48 through a thrust bearing 122 so as to be rotatable about a vertical axis. Outer sleeve 120 has a sprocket wheel 128 fixedly attached to it at its upper portion. This sprocket wheel 128 is connected through a chain 129 to a sprocket wheel 131 mounted around an output shaft of pulse motor 58 for rotation. (FIG. 1) Reference numerals 130 and 132 indicate tension pulleys for applying a tension to the chain 129. The driving mechanism of the head includes an inner sleeve (head driving force transmitting member) 134 which is inserted into the outer sleeve 120 and rotatably and concentrically supported by this outer sleeve. This upper sleeve 134 has a timing pulley 136 secured to it at its upper portion. This timing pulley 136 is connected through an endless timing belt 139 to a timing pulley 141 mounted around an output shaft of driving pulse motor 54 (FIG. 1). A reference numeral 137 designates a tension pulley for applying a tension to the timing belt. Inner sleeve 134 has another timing pulley 138 secured to it at its lower end. This timing pulley 138 is disposed within an enlarged diameter portion 140 of outer sleeve 120. Timing pulley 138 is connected through an endless timing belt 142 to a driving timing pulley 146 fastened to a needle driving shaft 144 of head 116 by means of a screw. Timing belt 142 passes through an opening 148 formed through enlarged diameter portion 140 of outer sleeve 120, and one side thereof is meshed with timing pulley 138 and the other side with driving timing pulley 146, with the intermediate portion thereof being meshed with a tension pulley 150 rotatably supported on casing 118 of the head. A vertical shaft 152 is tightly inserted into inner sleeve 134 to thereby rotate together with inner sleeve 134. within casing 126 of carriage 124 there is fixed a supporting frame 154 of an angle member in an inverted L-shape. The upper portion of shaft 152 passes through a hole 158 formed through a horizontal leg 156 of this supporting frame 154. An upper sleeve 160 is loosely fitted around the upper portion of shaft 152, and is rotatably supported on horizontal leg 156 by means of a bearing 161. Fastened by means of screws to an upper sleeve 160 are a toothed wheel 164 and a detecting member 162 including a rotary brush for detecting the top and bottom dead points of the needle and the rotation angle of the head. Toothed wheel 164 is engaged with a pinion 168 screwed to the upper end of another shaft 166 which is vertically and rotatably supported on horizontal leg 156. Another pinion 170 is screwed to the lower end of shaft 166, and this pinion 170 is meshed with a toothed wheel 172 screwed to the upper end of outer sleeve 120. Thus, the rotation of head 116 is transmitted through toothed wheel 172 of outer sleeve 120, pinions 170, 168, and toothed wheel 164 to detecting member 162, from which detection signals are fed to a numerical control device not shown to thereby control pulse motors 54, 56 58, and 60.

Figure 6:
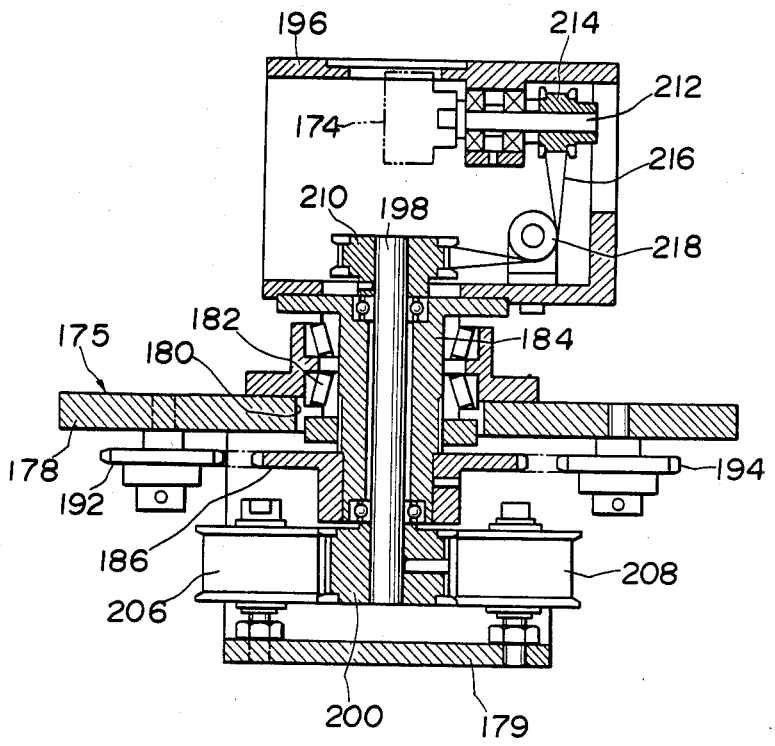
FIG. 6 is an enlarged vertical section showing actuating and rotating mechanisms of the rotating hook complete in FIG. 1.

FIG. 6 shows a rotating mechanism and drive mechanism of rotating hook complete 174 of base unit 50. The rotating mechanism of rotating hook complete 174 includes a sleeve 184 which passes through an opening 180 of a casing 178 of a carriage 175 of base unit 50, and which is supported on casing 178 through a thrust bearing 182 so as to be rotatable about a vertical axis. This sleeve 184 has at its lower end a sprocket wheel 186 screwed to it, the sprocket wheel 186 being connected through a chain 188 to a sprocket wheel 192 fixedly mounted around an output shaft 190 of rotation pulse motor 60. (FIG. 1) In FIG. 6 reference numerals 192 and 194 indicates tension wheels for applying tension to chain 188. The upper end of sleeve 184 is screwed to a casing (rotating hook supporting unit) 196 of rotating hook complete 174. The driving mechanism of rotating hook complete 174 is provided with a vertical shaft 198 which concentrically passes through sleeve 184, and which is rotatably supported on that sleeve 184. A timing pulley 200 is screwed to the lower end of vertical shaft 198, and is connected through a timing belt 202 to a timing pulley 204 mounted on an output shaft of pulse motor 56 for driving the rotating hook complete (see also FIG. 1). In FIG. 6, reference numerals 206, 208 designate tension pulleys for applying tension to timing belt 202, the pulleys being supported by an angle member 179 depending from a casing 178. Another timing pulley 210 is screwed to the upper end of vertical shaft 198. An endless timing belt 216 extends around this timing pulley 210 and a timing pulley 214 screwed to a driving shaft 212 of rotating hook complete 174. Driving shaft 212 is supported on casing 196 of the rotating hook complete so as to be rotatable about a horizontal axis. A reference numeral 218 designates a tension pulley, rotatably supported on casing 196, for applying tension to timing belt 216.

Now, the operation of the sewing machine having the above-described structure will be explained. A quilt is supported on supporting bed 110, and then drive pulse motors 54, 56 are actuated by the numerical control unit not shown, so that needle 46 and rotating hook complete 174 are actuated simultaneously with each other by the above-described driving mechanisms of the head and the rotating hook complete. In this state the driving of to-and-fro feed drive unit 26 causes frame 16 to move by the function of timing belt 22 in backward or forward directions along guide rails 12, so that sewing machine body 47 is moved relative to the quilt, and thus the quilt is linearly sewed in that direction, i.e., backward or forward direction. When lateral feed drive unit 62 is moved while to-and-fro feed drive unit 62 is stopped, the quilt is sewed laterally since timing belt 72 is moved around and thereby arm unit 48 and base unit 50 are synchronously moved along guide members 42, 44 in a lateral direction. When drive units 26 and 62 are simultaneously actuated, the quilt is sewed diagonally. When arm unit 48 and base unit 50 are laterally moved while frame 16 is moved either forwards or backwards, a zigzag sewing is applied. In this event since the drive mechanism of head 116 and that of rotating hook complete 174 are mounted-on arm unit 48 and base unit 50 respectively, a predetermined zigzag sewing is achieved without being affected by lateral feed mechanisms 64, 66 as in the prior art. When a complicated sewing such as embroidery or the like is to be performed, rotation pulse motors 58, 60 are controlled by the numerical control unit according to a predetermined program. The rotational forces of pulse motors 58, 60 are respectively transmitted through the rotation mechanism to head 116 and casing 196 of the rotating hook complete, so that head 116 and casing 196 of the rotating hook complete are synchronously rotated, and thus needle 46 and rotating hook complete 174 are directed in a direction of the movement of sewing machine body 47 relative to the quilt. While head 116 and casing 196 of the rotating hook complete are rotated, rotation shafts 144 and 212 are prevented from rotating respectively by a solenoid brake 220 provided to casing 118 to surround the outer end of drive shaft 144 of the head and by a solenoid brake, not shown, which is provided to casing 196 to surround drive shaft 212 of the rotating hook complete, and therefore timing pulleys 138, 210 of the driving mechanisms of the head 116 and rotating hook complete 174 are not rotated relative to head 116 and casing 196 respectively by the rotation of head 116 and casing 196 of the rotating hook complete. Therefore, precise embroidery sewing can be carried out since needle 46 and rotating hook complete 174 are not actuated under the influence of the rotation of head 116 and casing 196 of the rotating hook complete.

In the above-described embodiment, sleeve 134 and shaft 198 which are driving force transmitting members of the head and the rotating hook complete respectively are disposed inside sleeves 120, 184 which are rotation transmitting members of head 116 and rotating hook complete casing 196 respectively, but it would be clear that the embodiment may be modified so that the driving force transmitting members of the head and the rotating hook complete are coaxially disposed outside the rotation force transmitting members by forming the driving force transmitting members of the head and the rotating hook complete into a sleeve shape, in which event the lower end of outer sleeve 120 is not connected to head 116 and has on its outer periphery a timing pulley fixed to it, the timing pulley being engaged with belt 142, while the lower end of inner sleeve 134 is not provided with pulley 138 and is fixed to head 116. Structures similar to such structure may be used for the driving mechanism and rotating mechanism of the rotating hook complete.

Furthermore, in the above-described embodiment pulse motors are used as motors 26, 62, 54, 56, 58, and 60, but instead of these, appropriate motors such as servomotor and the like may be used.

INDUSTRIAL APPLICABILITY

The sewing machine according to this invention is useful and is suitable for use in complicated sewings, particularly in embroidery and the like.

I claim:

1. In a sewing machine in which a frame which is moved by to-and-fro feed means is provided to be movable forwards and backwards along guide means mounted to a base; an arm unit and a base unit of a sewing machine body are mounted to the frame in such a manner that the arm unit and the base unit are respectively supported and guided by a pair of horizontal upper and lower guide members, which are mounted to the frame and disposed vertically, to be laterally movable, the arm unit having a head and the base unit having a rotating hook complete and being separate from the arm unit; the arm unit and the base unit are moved by lateral feed means laterally and synchronously with each other along the guide members; and a supporting bed for supporting an article to be sewed is disposed between the arm unit and the base unit of the sewing machine body so that the supporting bed passes between the guide members, the improvement which comprises:

means mounted to the arm for driving the head, the driving means including a head driving motor; and means mounted to the base unit and having a rotating hook complete drive motor for driving the rotating hook complete; the arm unit including an arm carriage supported on the upper guide member to be laterally movable, a head suspended from the arm carriage to be rotatable about a vertical axis, and means mounted to the arm carriage and including a motor for rotating the head; the base unit including a base carriage supported on the lower guide member to be laterally movable, a rotating hook complete supporting unit having the rotating hook complete and mounted to an upper portion of the base carriage to be rotatable about a vertical axis, and means mounted to the base carriage and having a motor for rotating the rotating hook complete supporting unit; and said head drive motor and the rotating hook complete drive motor being mounted to the arm carriage and the case carriage respectively.

2. A sewing machine as recited in claim 1, wherein: said head rotating means comprises a first sleeve rotatably supported on the arm carriage about the vertical axis of the head, a lower end portion of the first sleeve being attached to the head; said head driving means comprises a cylindrical head driving force transmitting member, disposed to coaxially and spacedly pass through the first sleeve, for transmitting the head driving force from the head drive motor to a needle of the head; said hook complete driving means comprises a second sleeve rotatably supported on the base carriage about the vertical axis, an upper end portion of the second sleeve being attached to the hook complete supporting unit; and the hook complete drive means comprises a cylindrical hook complete driving force transmitting member, disposed to coaxially and spacedly pass through the second sleeve, for transmitting a hook complete driving force from the hook complete drive motor to the hook complete.

3. A sewing machine is recited in claim 2, comprising head braking means for applying a braking force to the head driving means to prevent the needle from displacement, and rotating hook complete braking means for applying a braking force to the rotating hook complete driving means to prevent the rotating hook complete from being actuated whereby when the head and the rotating hook complete supporting unit are rotated, the braking forces are applied to the head driving means and the rotating hook complete driving means.

4. A sewing machine as recited in claim 3, wherein said head braking means and the rotating hook complete braking means are solenoid brakes and are adapted to apply braking forces to a needle drive shaft and a rotating hook complete drive shaft.

* * * * *